US006972720B2

(12) United States Patent
Shikata et al.

(10) Patent No.: US 6,972,720 B2
(45) Date of Patent: Dec. 6, 2005

(54) ANTENNA DEVICE CAPABLE OF ADJUSTING FREQUENCY

(75) Inventors: Masaru Shikata, Fukushima-ken (JP); Kazuhiro Sasaki, Fukushima-ken (JP); Tomotaka Suzuki, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/994,940

(22) Filed: Nov. 22, 2004

(65) Prior Publication Data

US 2005/0116868 A1 Jun. 2, 2005

(30) Foreign Application Priority Data

Nov. 27, 2003 (JP) ..... 2003-397293
Jan. 16, 2004 (JP) ..... 2004-009552

(51) Int. Cl.[7] ..... H01Q 1/38
(52) U.S. Cl. ..... 343/700 MS; 343/750; 343/861
(58) Field of Search ..... 343/700 MS, 702, 343/767, 770, 723, 746, 750, 823, 861

(56) References Cited

U.S. PATENT DOCUMENTS 4,167,010 A * 9/1979 Kerr ..... 343/700 MS
5,410,322 A * 4/1995 Sonoda ..... 343/700 MS
5,442,366 A * 8/1995 Sanford ..... 343/700 MS
5,631,660 A * 5/1997 Higashiguchi et al. ..... 343/702
5,912,647 A * 6/1999 Tsuru et al. ..... 343/700 MS

FOREIGN PATENT DOCUMENTS

JP 2002-217637 8/2002
JP 2002-237714 8/2002

* cited by examiner

*Primary Examiner*—Shih-Chao Chen
*Assistant Examiner*—Marie Antoinette Cabucos
(74) *Attorney, Agent, or Firm*—Brinks Hofer Gilson & Lione

(57) ABSTRACT

An antenna device includes a ground conductor plate, and a radiating conductor plate made of a metal plate, which is spaced from the ground conductor plate. The radiating conductor plate is provided with adjusting means for adjusting the electrical length. Thus, the correction of the electrical lengths can be made even if there is a difference between the electrical lengths of the radiating conductor plate caused by assembling errors, etc. In addition, when the antenna device is used in a state in which it is connected to external equipment, the adjusting means allows the adjustment of the electrical lengths of the radiating conductor plate even if the electrical lengths of the radiating conductor plate are subjected to the electrical influence from the electrical equipment and its surrounding environment.

5 Claims, 14 Drawing Sheets

ANTENNA DEVICE CAPABLE OF ADJUSTING FREQUENCY

This application claims the benefit of priority to Japanese Patent Application No. 2003-397293 filed Nov. 27, 2003 and 2004-009552 filed on Jan. 16, 2004, both herein incorporated by reference.

BACKGROUND OF THE INVENTION

1. Field of the Invention

The present invention relates to a patch-type antenna device suitable to be used as a global positioning system (GPS) antenna, etc.

2. Description of the Related Art

Drawings related to a conventional antenna device will be explained, in which FIG. 28 is a plan view of the conventional antenna device, and FIG. 29 is a sectional view of principal parts of the conventional antenna device.

Next, a construction of the conventional antenna device will be described with reference to FIGS. 28 and 29. The conventional antenna device has a ground conductor 52 patterned on a top face of an insulating substrate 51, a radiating conductor plate 53 made of a metal plate, arranged above the ground conductor 52 at a predetermined distance in a parallel manner, and four supporting members 54 made of a dielectric material, set upright on the ground conductor 52.

Further, the radiating conductor plate 53 has a square shape. Four corners of the radiating conductor plate 53 are supported by the supporting members 54. Moreover, the radiating conductor plate 53 is connected to a feeding portion 55 such as a conductive line. This feeding portion 55 is inserted through a hole 56 which passes through the ground conductor 52 and the insulating substrate 51, and is connected to an antenna circuit, which is not shown (for example, see Japanese Unexamined Patent Application Publication No. 2002-237714).

Meanwhile, in such a conventional antenna device, even if there is a difference between electrical lengths due to assembling errors, etc., the difference cannot be corrected. In addition, when the antenna device is used in a state in which it is connected to external equipment, the electrical lengths of the radiating conductor plate 53 are subjected to the electrical influence from the electrical equipment and its surrounding environment, and thus the electrical lengths of the radiating conductor plate 53 are varied to cause the deviation of frequency (f0).

In the conventional antenna device, there is a problem in that, even if there is a difference between electrical lengths due to assembling errors, etc., the difference cannot be corrected. There is also a further problem in that, when the antenna device is used in a state in which it is connected to external equipment, the electrical lengths of the radiating conductor plate 53 are subjected to the electrical influence from electrical equipment and its surrounding environment, and thus the electrical lengths of the radiating conductor plate 53 are varied to cause the deviation of frequency.

SUMMARY OF THE INVENTION

Therefore, an object of the present invention is to provide an antenna device capable of adjusting the electrical lengths of a radiating conductor plate to adjust a frequency.

As first means to solve the problem, the present invention provides an antenna device comprising a ground conductor plate, and a radiating conductor plate made of a metal plate and spaced from the ground conductor plate. The radiating conductor plate is provided with adjusting means for adjusting an electrical length.

As second means to solve the problem, the present invention provides the antenna device in which the adjusting means is formed in a shape of a ladder obtained by a combination of holes and crosspieces which are provided between a central portion and an outer circumferential edge of the radiating conductor plate, and the crosspieces are cut to adjust the electrical length.

Further, as third means to solve the problem, the present invention provides the antenna device in which the radiating conductor plate has one or two feeding portions, and the ladder-shaped portion is formed at a position along a direction of an electric field generated on the radiating conductor plate.

Further, as fourth means to solve the problem, the present invention provides the antenna device in which the radiating conductor plate has the two feeding portions, and the adjusting means is provided on at least one line extending through a center of the radiating conductor plate from at least one of the feeding portions.

Further, as fifth means to solve the problem, the present invention provides the antenna device in which the radiating conductor plate has the one feeding portion, and the adjusting means is provided along second and/or third lines passing through a center of the radiating conductor plate and offset by 45 degrees with respect to a first line passing through a center from the power feeding part.

Further, as sixth means to solve the problem, the present invention provides the antenna device further comprises a circuit board arranged between the ground conductor plate and the radiating conductor plate. The radiating conductor plate has leg pieces attached to the circuit board, and extending portions provided at ends of the leg pieces and protruding through the circuit board for forming the adjusting means, and the extending portions are cut to adjust the electrical length.

Further, as seventh means to solve the problem, the present invention provides the antenna device in which the circuit board is placed on the ground conductor plate made of a metal plate, the radiating conductor plate has first and second electrical lengths which exists on two lines through the center of the radiating conductor plate orthogonal to each other, two of the leg pieces are arranged correspondingly to the first and second electrical lengths, and the extending portions provided at the respective leg pieces protrude through the radiating conductor plate, and the extending portions protruding through the ground conductor plate are cut to adjust the electrical length.

An antenna device of the present invention comprises a ground conductor plate, and a radiating conductor plate having a metal plate and spaced from the ground conductor plate. The radiating conductor plate is provided with adjusting means for adjusting an electrical length.

As described above, when the radiating conductor plate is provided with the adjusting means for adjusting the electrical lengths of the radiating conductor plate, the correction of the electrical lengths can be made even if a difference between the electrical lengths of the radiating conductor plate is produced due to assembling errors, etc. In addition, when the antenna device is used in a state in which it is connected to external equipment, the adjusting means allows the adjustment of the electrical lengths of the radiating conductor plate even if the electrical lengths of the radiating conductor plate are subjected to the electrical influence from the electrical equipment and its surrounding environment.

As a result, it is possible to obtain an antenna device with good performance, which can adjust a frequency.

Further, the adjusting means is formed in a shape of a ladder obtained by the combination of holes and crosspieces, which are provided between a central portion and an outer circumferential edge of the radiating conductor plate, and the crosspieces are cut to adjust the electrical length. Thus, it is possible to obtain an antenna device with simple construction and good productivity.

Further, the radiating conductor plate has one or two feeding portions, and the ladder-shaped portion is formed at a position along a direction of an electric field generated on the radiating conductor plate. Thus, it is possible to obtain an antenna device, which can adjust an electrical length at a position having a great electrical influence, and provide good adjustment effects.

Further, the antenna device in which the radiating conductor plate has the two feeding portions, and the adjusting means is provided on at least one line extending through the center of the radiating conductor plate from at least one of the feeding portions. Thus, it is possible to provide an antenna device, which can easily form the adjusting means, adjust an electrical length at a position having a great electrical influence, and provide good adjustment effects.

Further, the radiating conductor plate has the one feeding portion, and the adjusting means is provided along second and/or third lines passing through the center of the radiating conductor plate and offset by 45 degrees with respect to a first line through the center from the feeding portion. Thus, it is possible to provide an antenna device, which can easily form the adjusting means, adjust an electrical length at a position having a great electrical influence, and provide good adjustment effects.

Further, the antenna device further comprises a circuit board arranged between the ground conductor plate and the radiating conductor plate. The radiating conductor plate has leg pieces attached to the circuit board, and extending portions provided at ends of the leg pieces and protruding through the circuit board for forming the adjusting means, and the extending portions are cut to adjust the electrical length. Thus, it is possible to obtain an antenna device, which can be stably attached, provide a radiating conductor plate of simplified construction, and provide good productivity.

Further, the circuit board is placed on the ground conductor plate made of a metal plate, the radiating conductor plate has first and second electrical lengths which exists on two lines through the center of the radiating conductor plate orthogonal to each other, two of the leg pieces are arranged corresponding to the first and second electrical lengths, and the extending portions provided at the respective leg pieces protrude through the radiating conductor plate, and the extending portions protruding through the ground conductor plate are cut to adjust the electrical length. Thus, the ends of the extending portions can be cut to adjust the electrical lengths of the radiating conductor plate, respectively. As a result, it is possible to obtain an antenna device, which can easily adjust the electrical lengths, provide a radiating conductor plate of simplified construction, and provide good productivity.

DESCRIPTION OF THE PREFERRED EMBODIMENT

Figure 1:
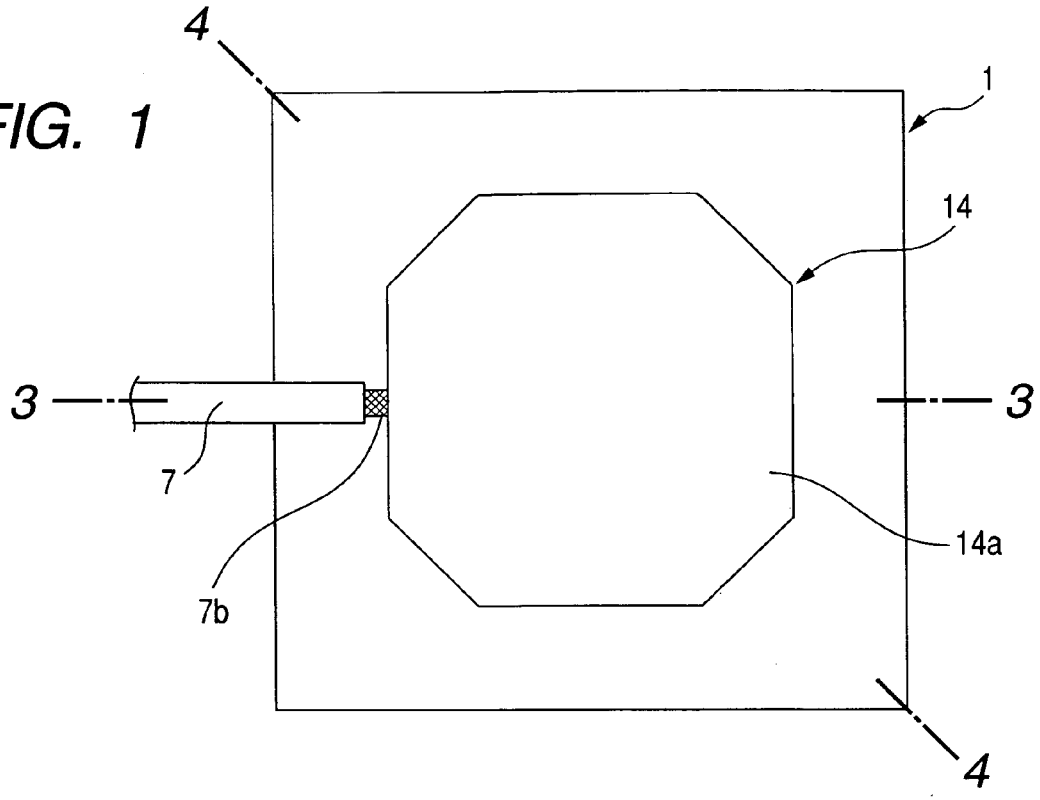
FIG. 1 is a plan view of an antenna device according to a first embodiment of the present invention.
Figure 2:
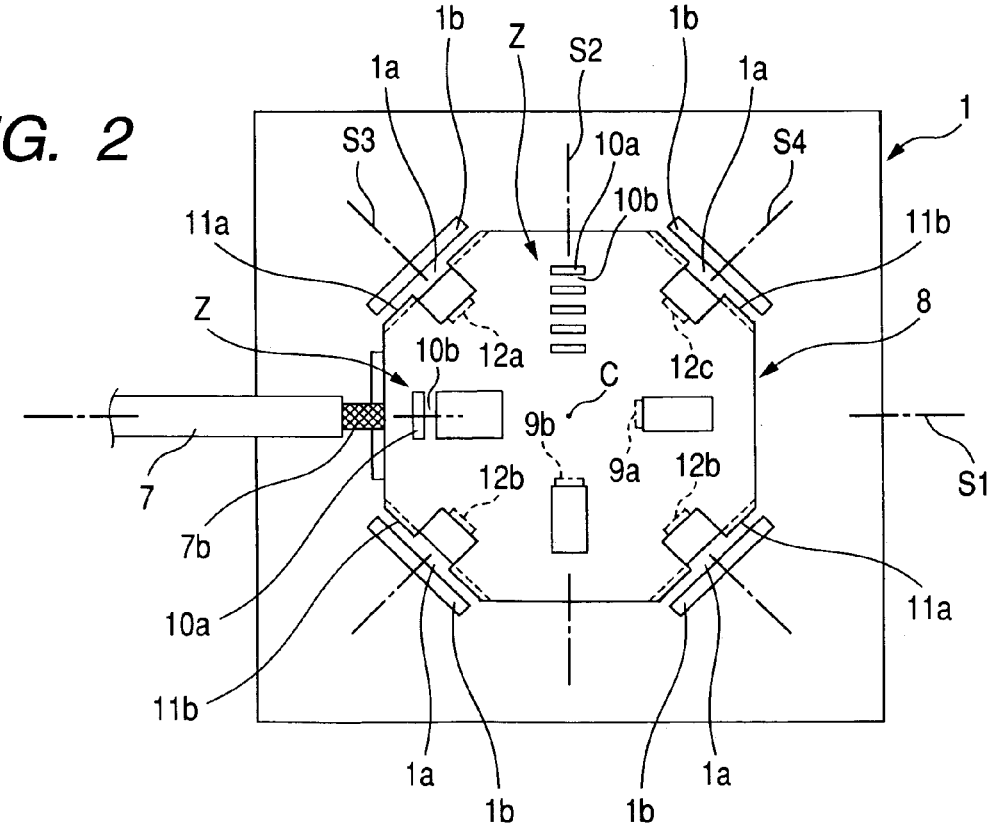
FIG. 2 is a plan view of the antenna device according to the first embodiment of the present invention, which illustrates a state in which a cover is removed.
Figure 3:
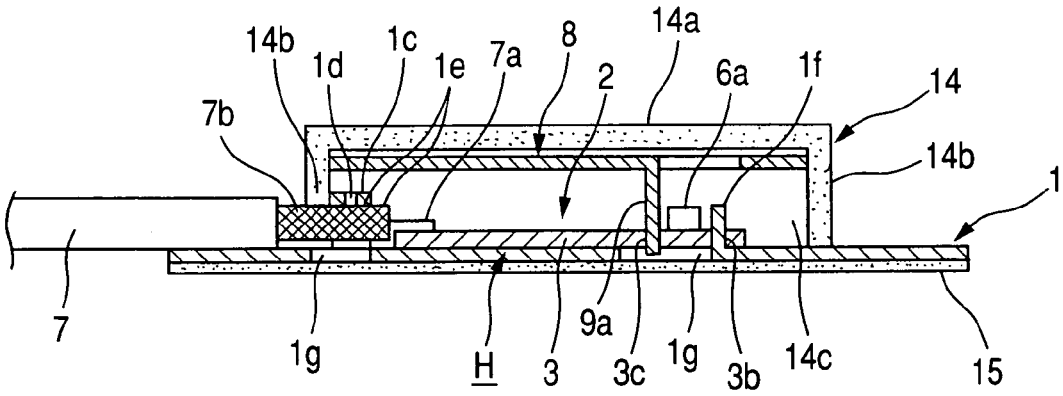
FIG. 3 is a sectional view taken along a line 3—3 in FIG. 1.
Figure 4:
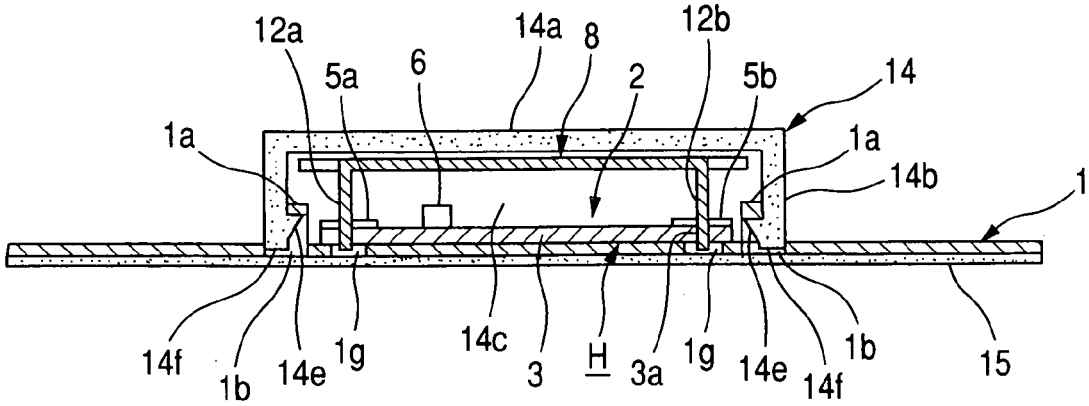
FIG. 4 is a sectional view taken along a line 4—4 in FIG. 1.
Figure 5:
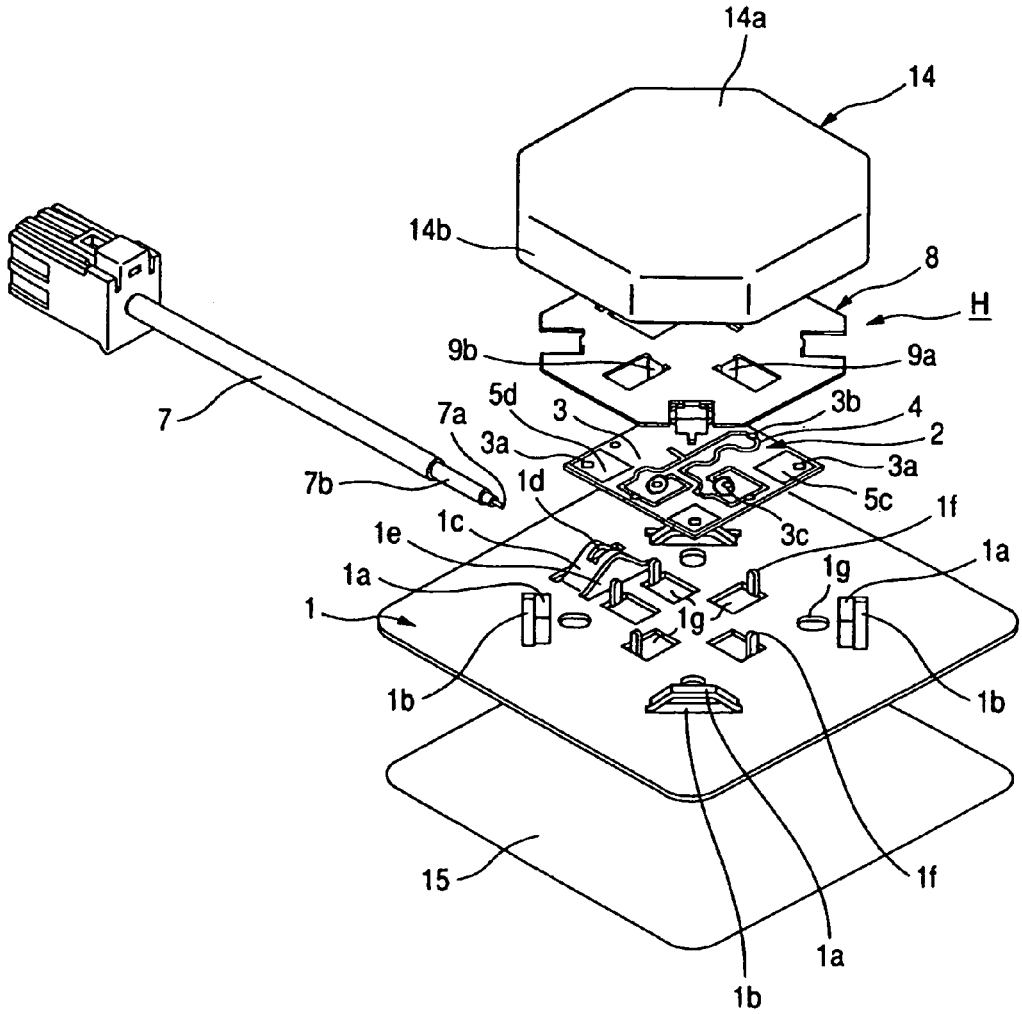
FIG. 5 is an exploded perspective view of the antenna device according to the first embodiment of the present invention.

The accompanying drawings related to an antenna device of the present invention will now be described. FIG. 1 is a plan view of an antenna device according to a first embodiment of the present invention; FIG. 2 is a plan view of the antenna device according to the first embodiment of the present invention, which illustrates a state in which a cover is removed; FIG. 3 is a sectional view taken along a line 3—3 in FIG. 1; FIG. 4 is a sectional view taken along a line 4—4 in FIG. 1; and FIG. 5 is an exploded perspective view of the antenna device according to the first embodiment of the present invention.

Figure 6:
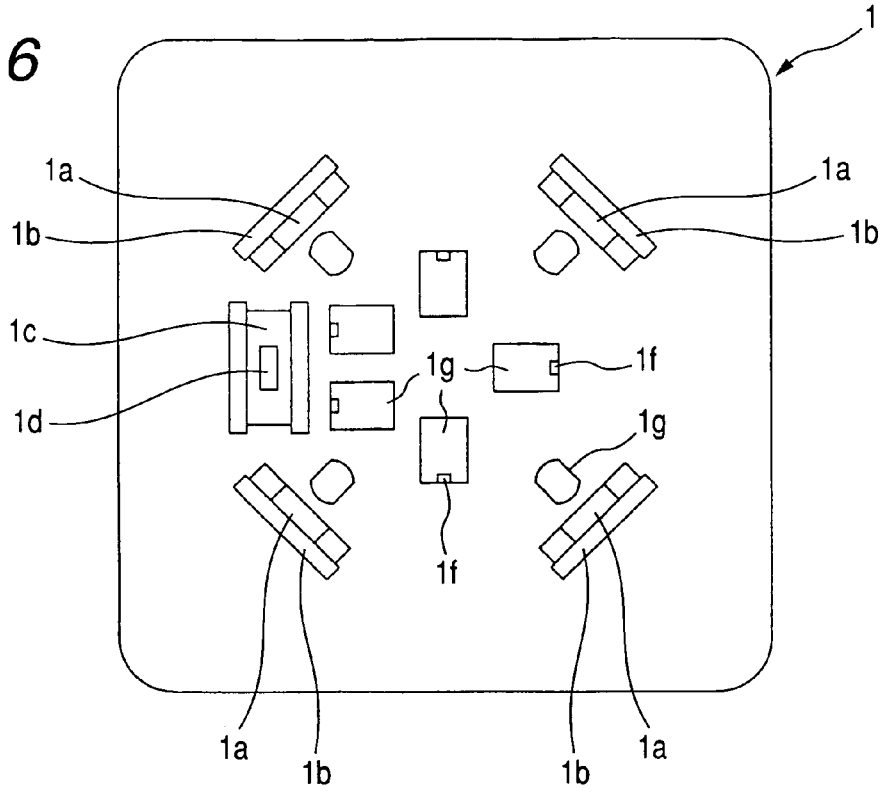
FIG. 6 is a plan view of a ground conductor plate of the antenna device according to the first embodiment of the present invention.
Figure 7:
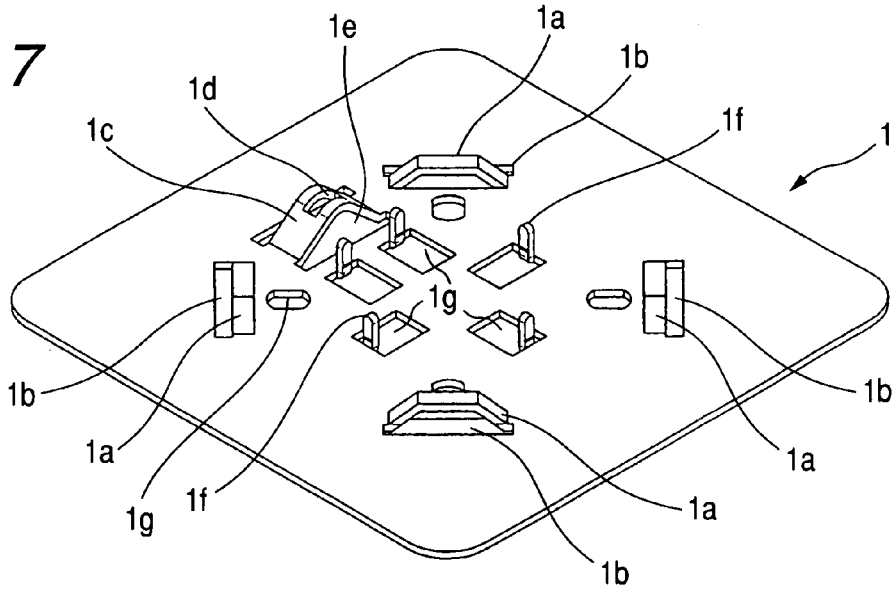
FIG. 7 is a perspective view of the ground conductor plate of the antenna device according to the first embodiment of the present invention.
Figure 8:
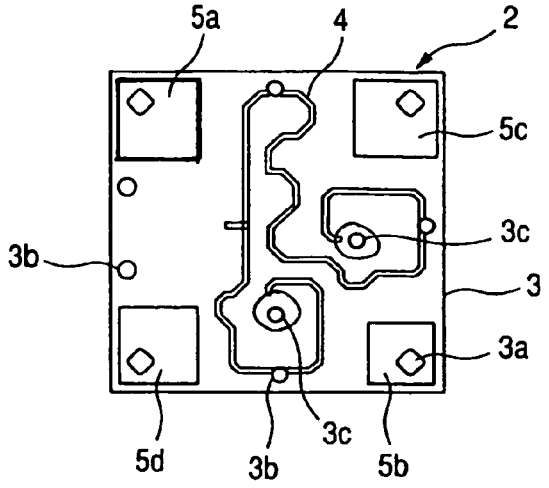
FIG. 8 is a plan view of a circuit board of the antenna device according to the first embodiment of the present invention.
Figure 9:
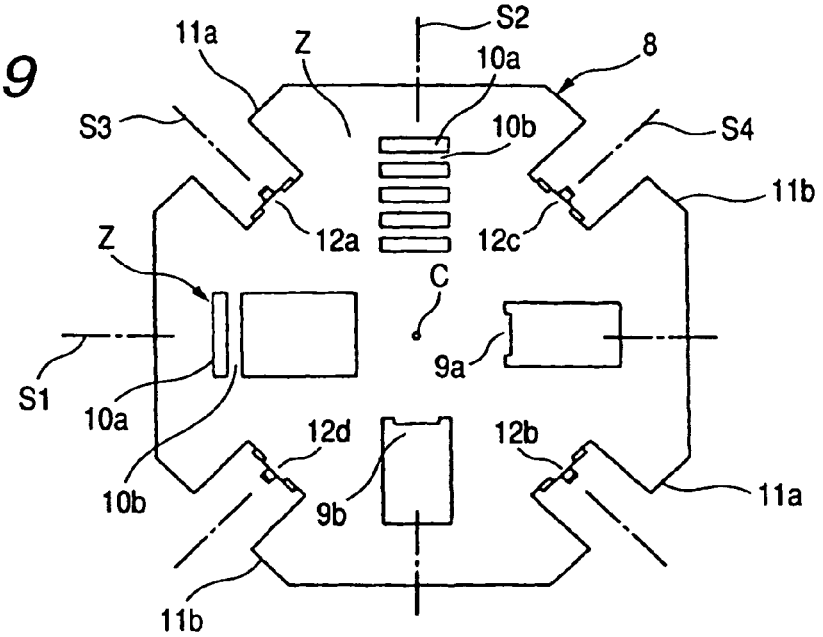
FIG. 9 is a plan view of a radiating conductor plate of the antenna device according to the first embodiment of the present invention.
Figure 10:
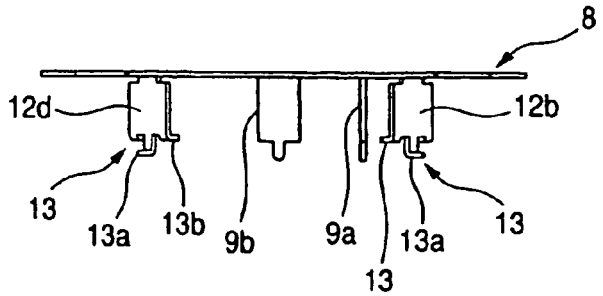
FIG. 10 is a front view of the radiating conductor plate of the antenna device according to the first embodiment of the present invention.
Figure 11:
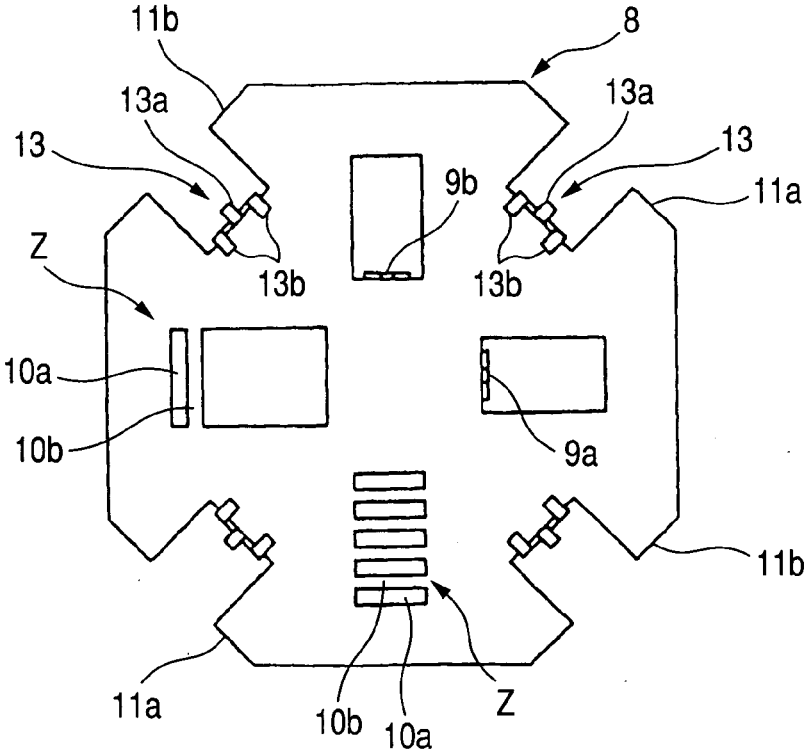
FIG. 11 is a bottom view of the radiating conductor plate of the antenna device according to the first embodiment of the present invention.

Further, FIG. 6 is a plan view of a ground conductor plate of the antenna device according to the first embodiment of the present invention; FIG. 7 is a perspective view of the ground conductor plate of the antenna device according to the first embodiment of the present invention; FIG. 8 is a plan view of a circuit board of the antenna device according to the first embodiment of the present invention; FIG. 9 is a plan view of a radiating conductor plate of the antenna device according to the first embodiment of the present invention; FIG. 10 is a front view of the radiating conductor plate of the antenna device according to the first embodiment of the present invention; FIG. 11 is a bottom view of the radiating conductor plate of the antenna device according to the first embodiment of the present invention.

Figure 12:
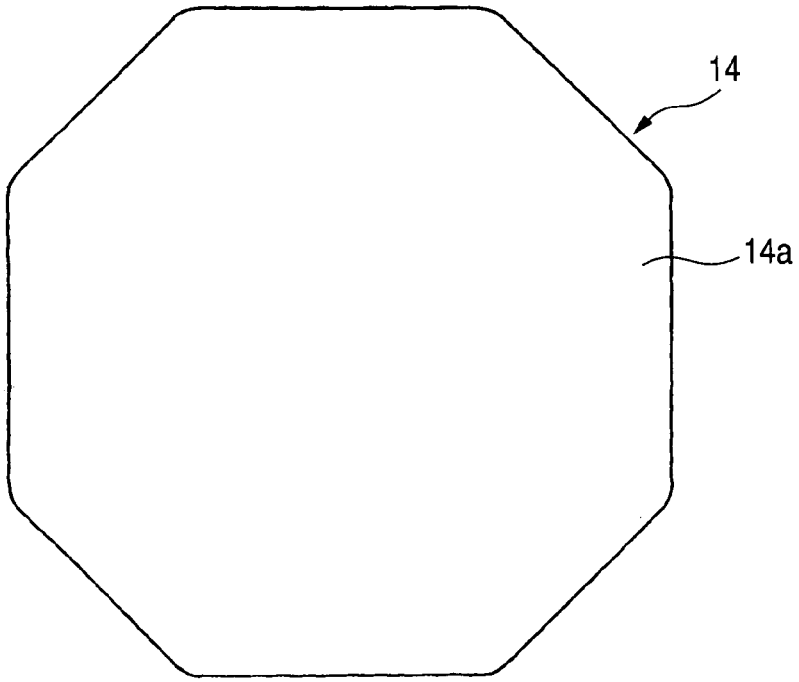
FIG. 12 is a plan view of a cover of the antenna device according to the first embodiment of the present invention.
Figure 13:
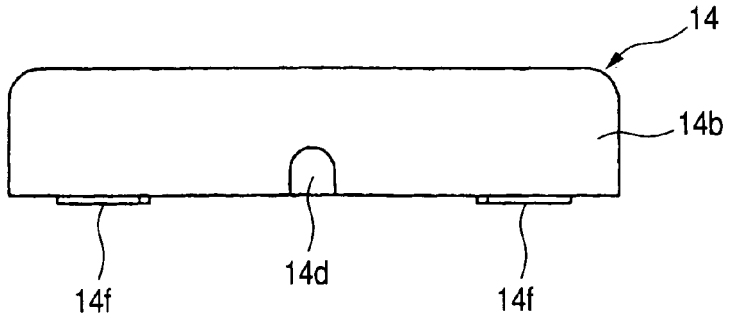
FIG. 13 is a left side view of the cover of the antenna device according to the first embodiment of the present invention.
Figure 14:
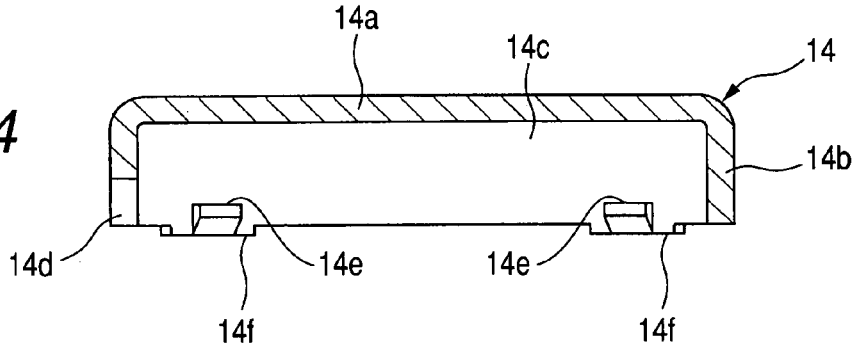
FIG. 14 is a sectional view of principal parts of the cover of the antenna device according to the first embodiment of the present invention.
Figure 15:
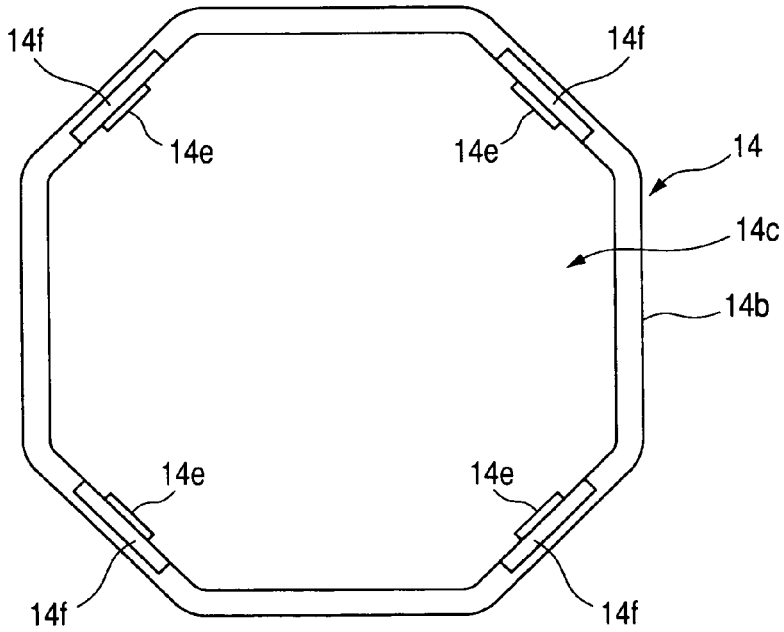
FIG. 15 is a bottom view of the cover of the antenna device according to the first embodiment of the present invention.

Further, FIG. 12 is a plan view of a cover of the antenna device according to the first embodiment of the present invention; FIG. 13 is a left side view of the cover of the antenna device according to the first embodiment of the present invention; FIG. 14 is a sectional view of principal parts of the cover of the antenna device according to the first embodiment of the present invention; and FIG. 15 is a bottom view of the cover of the antenna device according to the first embodiment of the present invention.

Figure 16:
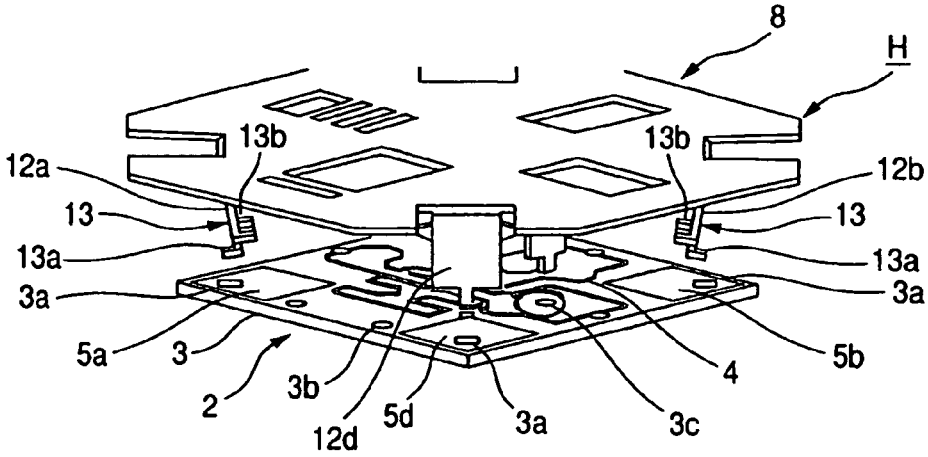
FIG. 16 is an explanatory view of the antenna device according to the first embodiment of the present invention, which illustrates a first process of a method of attaching the radiating conductor plate to the circuit board.
Figure 17:
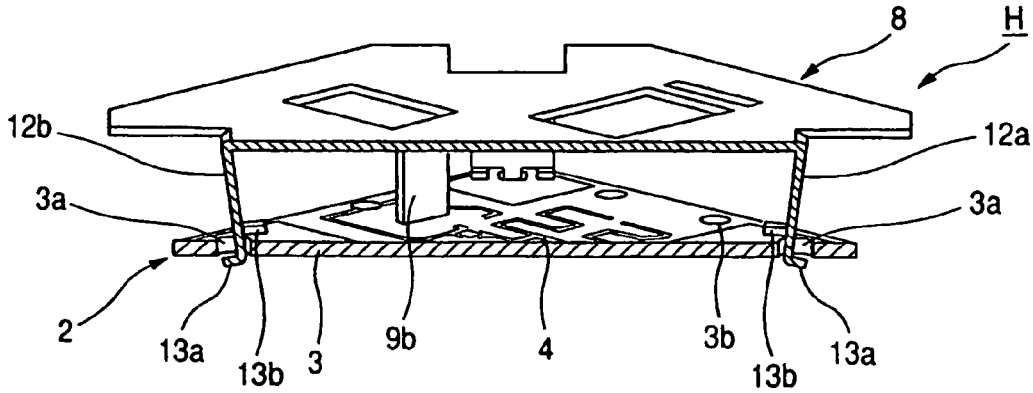
FIG. 17 is an explanatory view of the antenna device according to the first embodiment of the present invention, which illustrates a second process of the method of attaching the radiating conductor plate to the circuit board.
Figure 18:
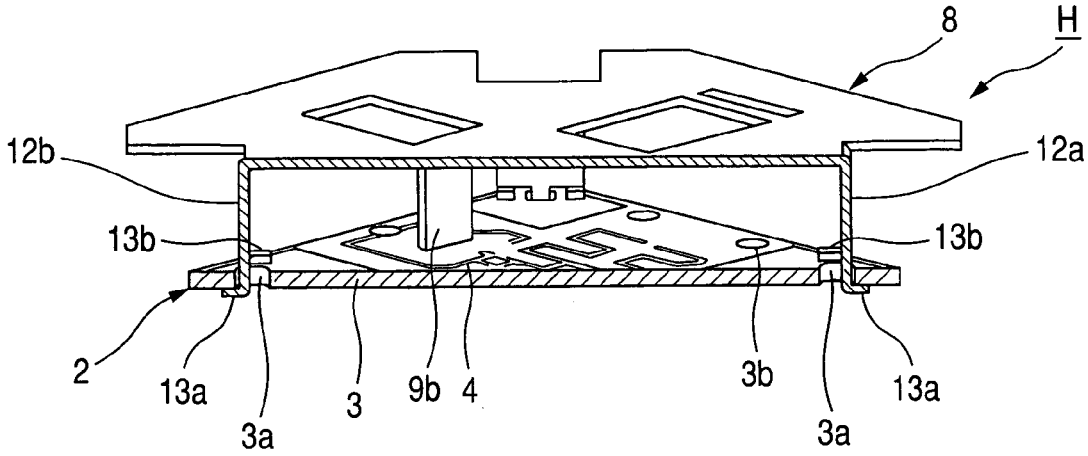
FIG. 18 is an explanatory view of the antenna device according to the first embodiment of the present invention, which illustrates a third process of the method of attaching the radiating conductor plate to the circuit board.
Figure 19:
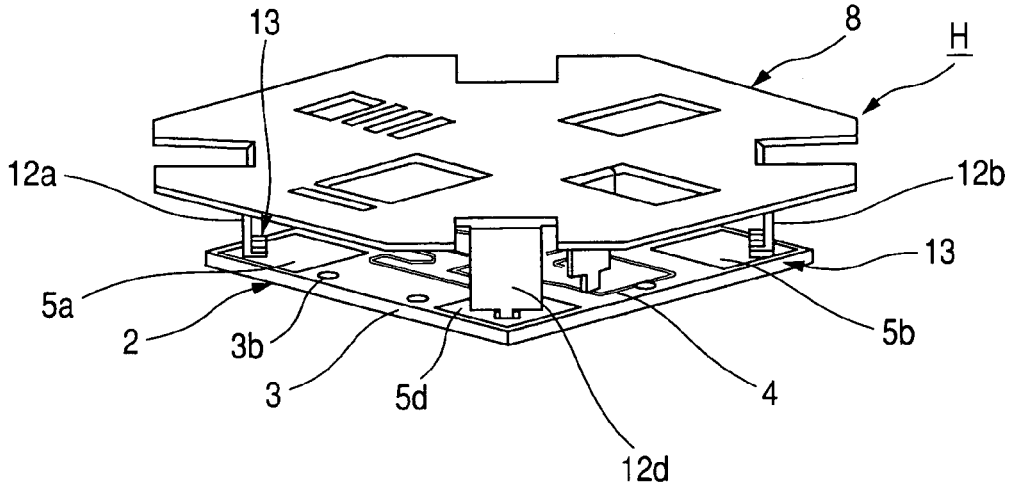
FIG. 19 is a perspective view of the antenna device according to the first embodiment of the present invention, which illustrates a state in which the attachment of the radiating conductor plate to the circuit board is completed.

Further, FIG. 16 is an explanatory view of the antenna device according to the first embodiment of the present invention, which illustrates a first process of a method for attaching the radiating conductor plate to the circuit board; FIG. 17 is an explanatory view of the antenna device according to the first embodiment of the present invention, which illustrates a second process of the method for attaching the radiating conductor plate to the circuit board; FIG. 18 is an explanatory view of the antenna device according to the first embodiment of the present invention, which illustrates a third process of the method for attaching the radiating conductor plate to the circuit board; and FIG. 19 is a perspective view of the antenna device according to the first embodiment of the present invention, which illustrates a state in which the attachment of the radiating conductor plate to the circuit board is completed.

Figure 20:
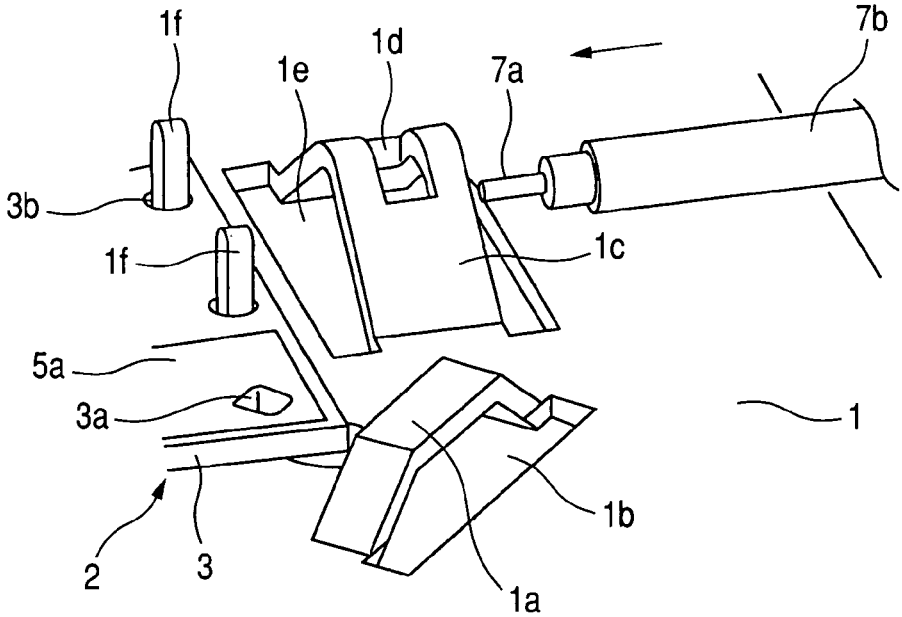
FIG. 20 is an explanatory view of the antenna device according to the first embodiment of the present invention, which illustrates a method of attaching a cable to the ground conductor plate.
Figure 21:
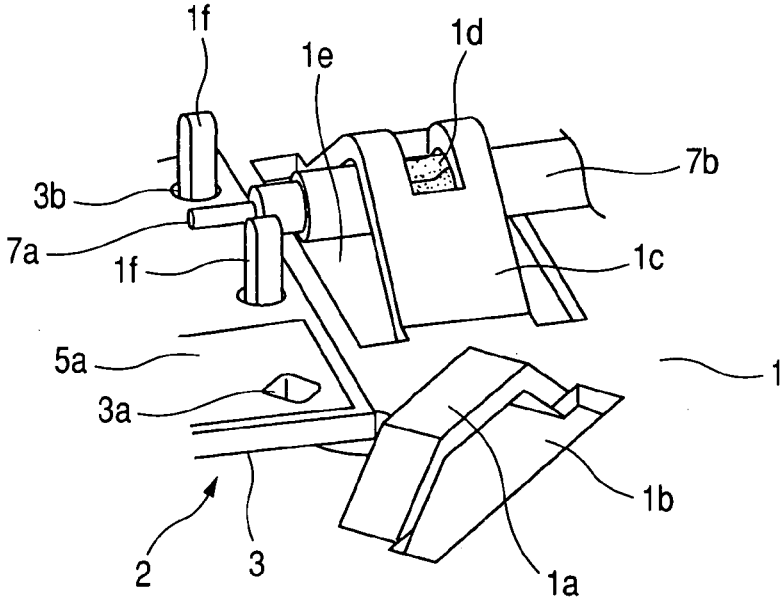
FIG. 21 is a perspective view of the antenna device according to the first embodiment of the present invention, which illustrates a state in which the attachment of the cable to the ground conductor plate is completed.

Further, FIG. 20 is an explanatory view of the antenna device according to the first embodiment of the present invention, which illustrates a method of attaching a cable to the ground conductor plate; FIG. 21 is a perspective view of the antenna device according to the first embodiment of the present invention, which illustrates a state in which the attachment of the cable to the ground conductor plate is completed.

Figure 22:
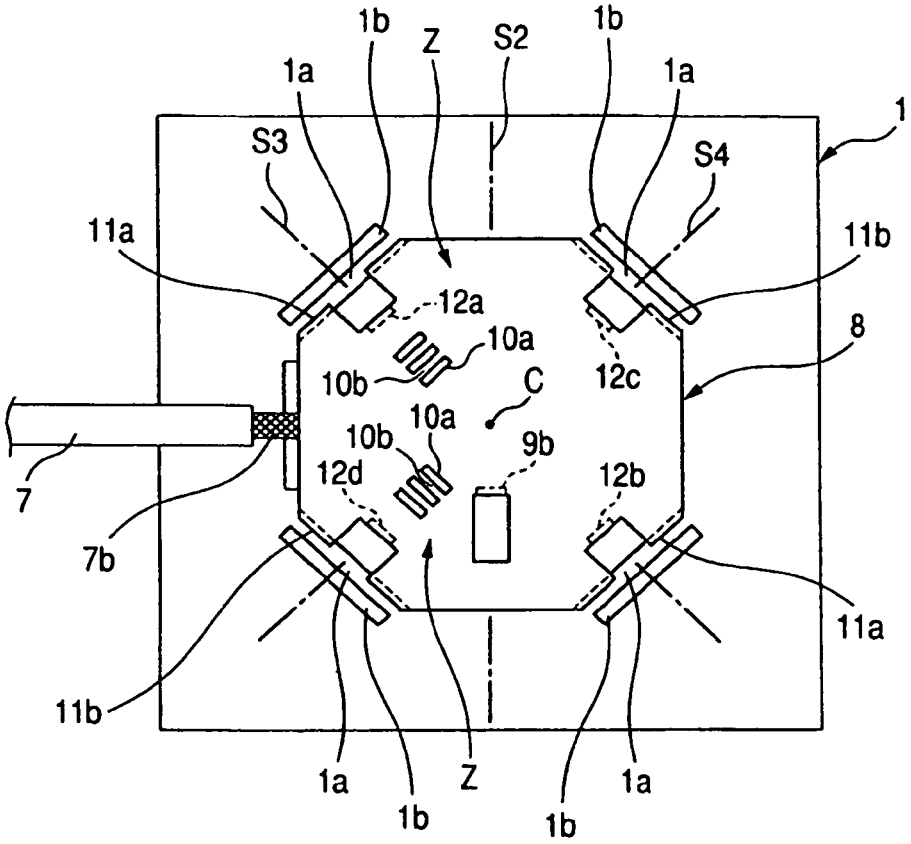
FIG. 22 is a plan view of an antenna device according to a second embodiment of the present invention, which illustrates a state in which a cover is removed.
Figure 23:
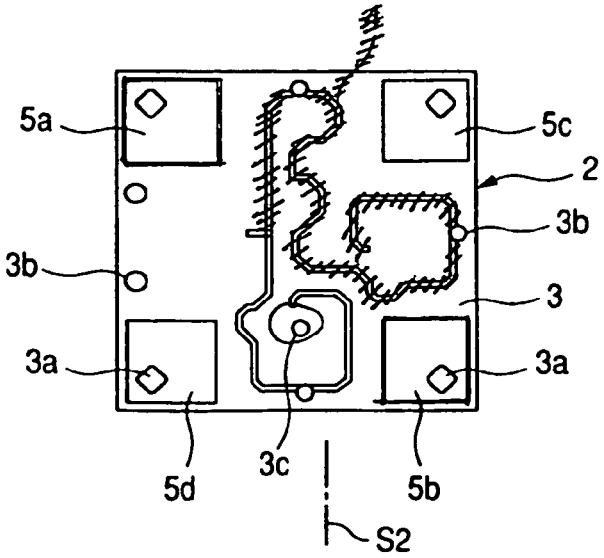
FIG. 23 is a plan view of a circuit board of the antenna device according to the second embodiment of the present invention.
Figure 24:
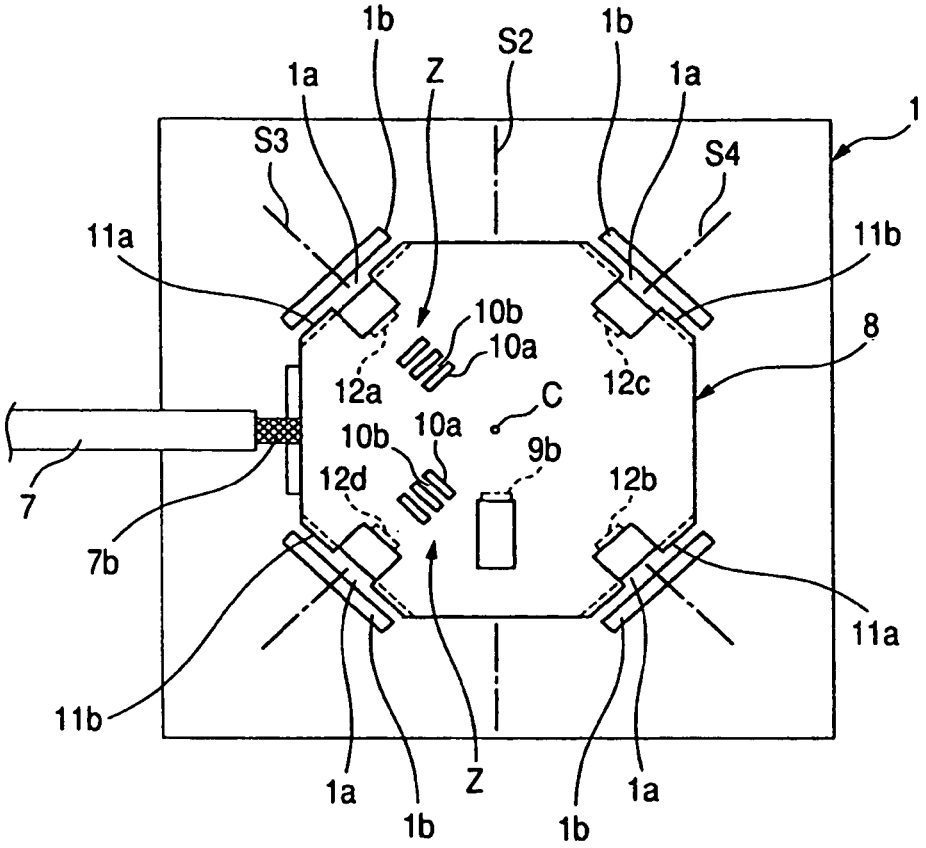
FIG. 24 is a plan view of an antenna device according to a third embodiment of the present invention, which illustrates a state in which a cover is removed.
Figure 25:
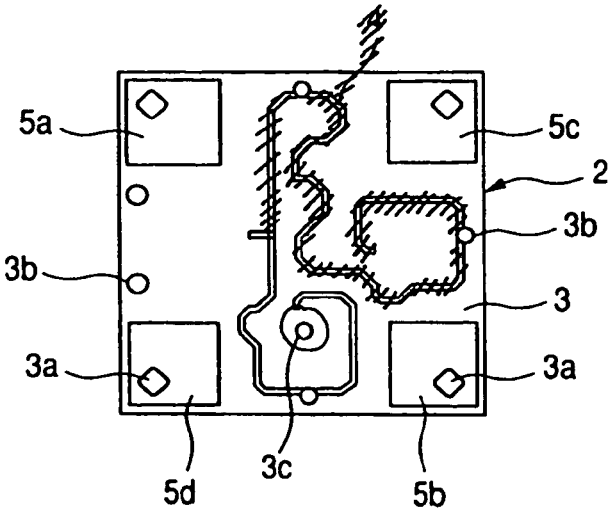
FIG. 25 is a plan view of a circuit board of the antenna device according to the third embodiment of the present invention.
Figure 26:
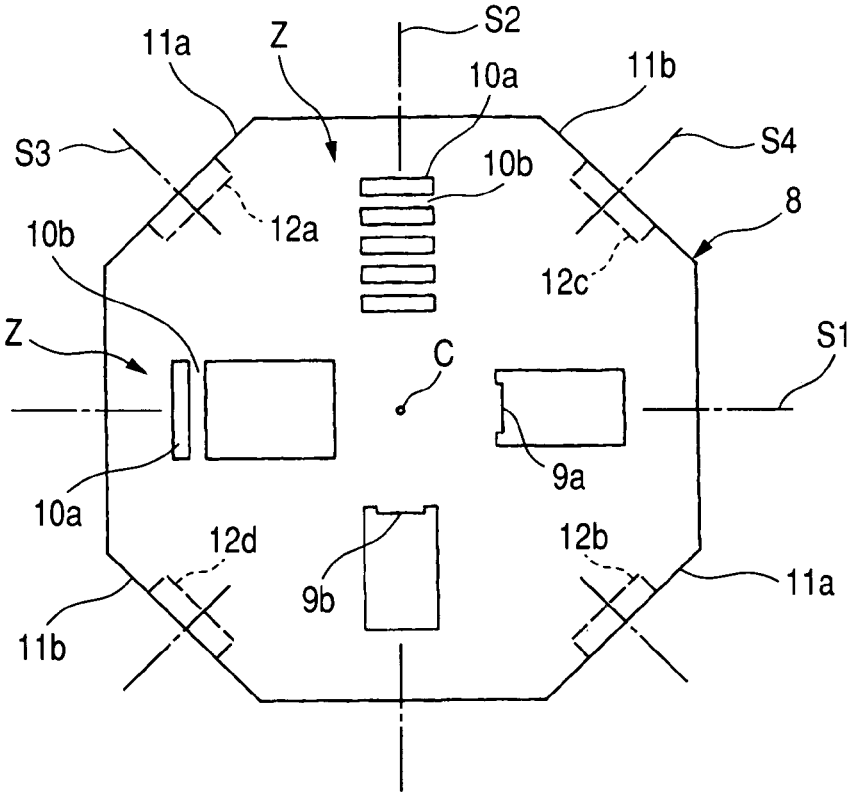
FIG. 26 is a plan view of a radiating conductor plate of an antenna device according to a fourth embodiment of the present invention.
Figure 27:
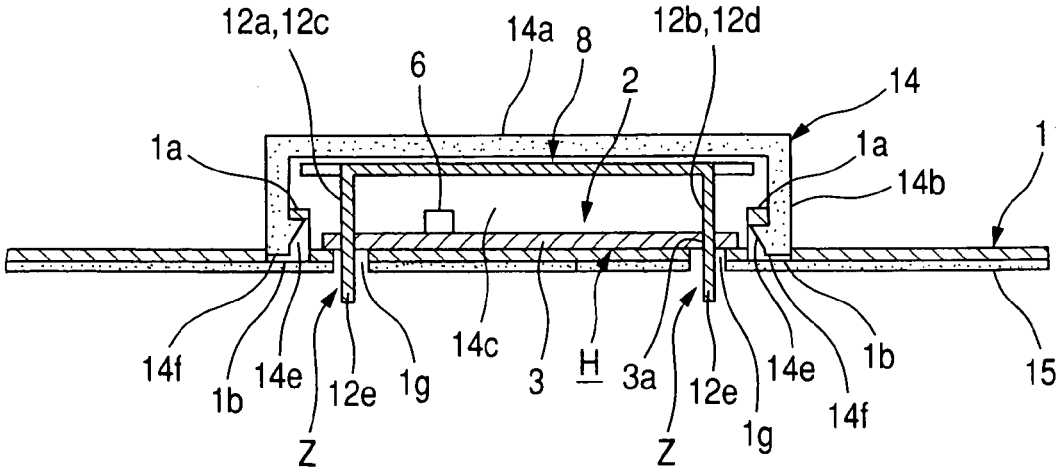
FIG. 27 is a sectional view of principal parts of an antenna device according to a fifth embodiment of the present invention.
Figure 28:
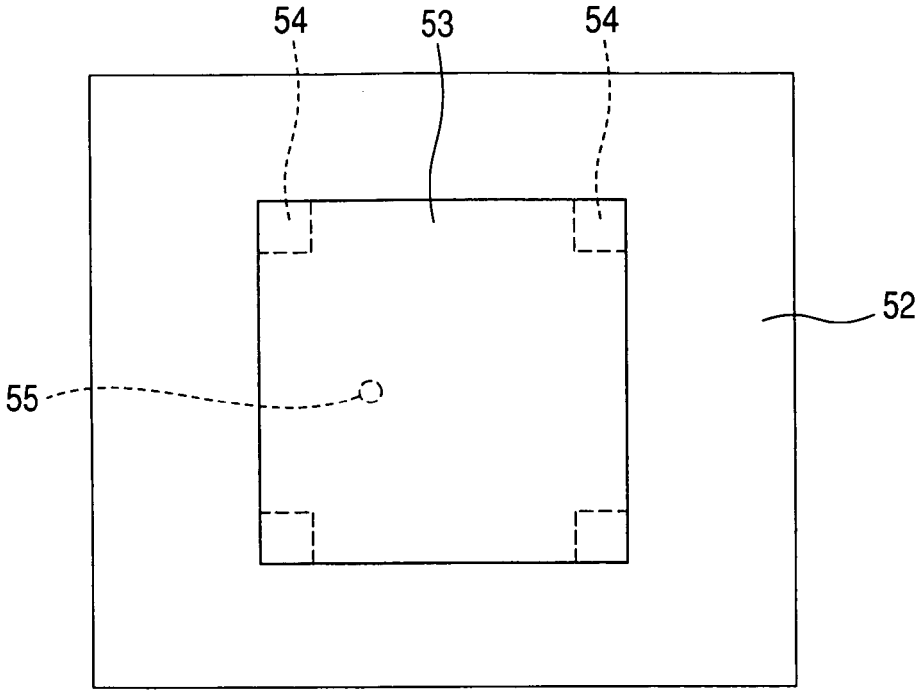
FIG. 28 PRIOR ART
FIG. 28 is a plan view of a conventional antenna device.
Figure 29:
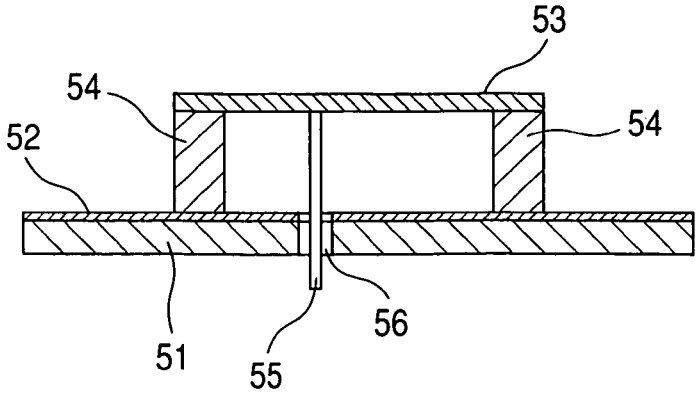
FIG. 29 PRIOR ART
FIG. 29 is a sectional view of principal parts of the conventional antenna device.

Further, FIG. 22 is a plan view of an antenna device according to a second embodiment of the present invention, which illustrates a state in which a cover is removed; FIG. 23 is a plan view of a circuit board of the antenna device according to the second embodiment of the present invention; FIG. 24 is a plan view of an antenna device according to a third embodiment of the present invention, which illustrates a state in which a cover is removed; FIG. 25 is a plan view of a circuit board of the antenna device according to the third embodiment of the present invention; FIG. 26 is a plan view of a radiating conductor plate of an antenna device according to a fourth embodiment of the present invention; and FIG. 27 is a sectional view of principal parts of an antenna device according to a fifth embodiment of the present invention.

Next, the construction of an antenna device according to a first embodiment of the present invention will now be described with reference to FIGS. 1 to 21. Particularly, as shown in FIGS. 6 and 7, a ground conductor plate 1 serving as a grounding conductor is made of a metal plate. The ground conductor plate 1 has a plurality of hooking portions 1*a* which are located in four directions and cut and bent upward arcuately, holes 1*b* which are respectively provided adjacent to the hooking portions 1*a*, a plurality of stopper portions 1*c* which are located between the two hooking portions 1*a* and are cut and bent upward arcuately, cut-out portions 1*d* such as through-holes which are respectively provided in the vicinity of apexes of the stopper portions 1*c*, and inserting parts 1*e* which are respectively provided below the stopper portions 1*c*.

Further, the ground conductor plate 1 has a plurality of bent pieces 1*f* which are bent upward, and release portions 1*g* which are provided at a plurality of spots including portions adjacent to the bent pieces 1*f*.

Particularly, as shown in FIG. 8, a rectangular circuit board 2 has a dielectric substrate 3 which is made of a dielectric plate, a wiring pattern 4 provided on the dielectric substrate 3, and a plurality of first, second, third and fourth electrode 5*a*, 5*b*, 5*c* and 5*d* provided at four corners of the dielectric substrate 3.

Further, the first and second diagonally opposite electrodes 5*a* and 5*b* are formed to have the same area, and the third and fourth diagonally opposite electrodes 5*c* and 5*d* are also formed to have the same area, while the areas of the first and second electrodes 5*a* and 5*b* are smaller than those of the third and fourth electrodes 5*c* and 5*d*.

Moreover, the dielectric substrate 3 has a plurality of penetrating portions 3*a* such as through-holes which are respectively provided at the positions of the first to fourth electrode 5*a* to 5*d*, a plurality of first holes 3*b* provided in the vicinity of the outer circumferential edge thereof, and a plurality of second holes 3*c* provided at the central part thereof.

Also, the circuit board 2 is mounted with short chip-type capacitors, etc. and electronic components 6 including a tall dielectric filter 6*a*, etc., and is formed with electric circuits such as a matching circuit, a filter circuit, and an amplifying circuit.

Further, the tall electronic components 6 including the dielectric filter 6*a*, etc., are arranged in the vicinity of the outer circumferential edge of the circuit board 2.

In such a circuit board 2, particularly, as shown in FIGS. 3 and 5, a bottom face of the circuit board 2 is placed on the ground conductor plate 1 with the bent pieces if inserted through the first holes 3*b*, and the bent pieces if are then soldered to the wiring pattern 4, so that the circuit board 2 is supported by the bent pieces 1*f*.

In that case, the bent pieces 1*f* pass through the first holes 3*b* such that the ends thereof protrude upward, and the release portions 1*g* of the ground conductor plate 1 are respectively located below the penetrating portions 3*a* and the second holes 3*c* of the circuit board 2 such that they escape from the ground conductor plate 1.

Further, when the circuit board 2 is mounted on the ground conductor plate 1, the first to fourth electrodes 5*a* to 5*d* are disposed opposite to the ground conductor plate 1 with the dielectric substrate 3 interposed therebetween, thereby forming capacitors, respectively.

A coaxial cable 7 has a central conductor 7*a*, and a net-shaped outer conductor 7*b* to cover the outside of the central conductor 7*a* with an insulating coating interposed between the central conductor and outer conductor. As shown in FIG. 20, the attachment of the cable 7 is first performed by inserting the end of the cable 7 into the inserting portion 1*e* of the stopper portion 1*c* to be a state as shown in FIG. 21.

Then, in the state shown in FIG. 21, the central conductor 7*a* is soldered to the wiring pattern 4, and the outer conductor 7*b* and the stopper portion 1*c* are soldered to each other at a position where the cut-out portion 1*d* is located, such that the cable 7 is supported by the stopper portion 1*c*.

Particularly, as shown in FIGS. 9 to 11, an octagonal radiating conductor plate 8 made of a metal plate has first and second feeding portions 9*a* and 9*b* comprised of bent pieces which are bent downward at positions orthogonal to each other, and adjusting means Z provided on a line S1 passing through the first feeding portion 9*a* and a center C and on a line S2 passing through the second feeding portion 9*b* and the center C for adjusting the electrical length.

Also, an electric field in the radiating conductor plate 8 takes directions along the lines S1 and S2, and has a first electrical length generated in the direction along the line S1 and a second electrical length generated in the direction along the line S2.

Further, the adjusting means Z is provided at positions of the lines S1 and S2 that become the directions of an electric field, and is provided between the central portion and the outer circumferential edge of the radiating conductor plate 8 at spots excluding the central portion thereof.

Moreover, the adjusting means Z is provided at opposing sides past the center C from the first and second feeding portions 9*a* and 9*b*, and is formed in a shape of a ladder obtained by combining holes 10*a* with crosspieces 10*b*. The electrical length can be adjusted so as to be longer by cutting the crosspieces 10*a*.

Further, the radiating conductor plate 8 has a pair of first opposing sides 11*a* and a pair of second opposing sides 11*b*, which are respectively located on lines S3 and S4 through the center C orthogonal to each other, and four leg pieces 12*a*, 12*b*, 12*c* and 12*c*, which are provided at spots excluding the central portion of the radiating conductor plate between the first opposites sides 11*a* on the line S3 and between the second opposing sides 11*b* on the line S4.

The four leg pieces 12*a* to 12*d* are formed to be bent downward at positions where the distances thereof from the center C are equal to each other, and are provided at positions closer to the center C than to the first and second opposing sides 11*a* and 11*b*.

Further, the electric field strength of the radiating conductor plate 8 is strong at certain spots at the outer circumferential portion of the radiating conductor plate 8 on the lines S1 and S2. However, the leg pieces 12*a* to 12*d* are provided at spots that are located away from the lines S1 and S2 to provide a relatively weak electric field strength.

Further, the respective ends of the leg pieces 12*a* to 12*d* are provided with locking portions 13, each of which has a first locking piece 13*a* that is located at the lowermost portion of each of the leg piece, and second locking pieces 13*b* which are provided at a distance from the first locking pieces 13*a*.

Also, the first and second locking pieces 13*a* and 13*b* has bent portions which are bent in directions opposite to each other with respect to the respective leg pieces 12*a* to 12*d*.

As shown in FIG. 16, the attachment of the radiating conductor plate 8 having such construction is first performed by inwardly bending the leg pieces 12*a* to 12*d* against spring forces of the leg pieces 12*a* to 12*d*, in a state in which the radiating conductor plate 8 is disposed on the circuit board 2.

Next, as shown in FIG. 17, convex portions at the ends of the first and second feeding portions 9*a* and 9*b* are fitted into the second holes 3*c*, and the locking portions 13 of the leg pieces 12*a* to 12*d* are respectively inserted into the penetrating portions 3*a*.

Thereafter, as shown in FIG. 18, when inward bending forces of the leg pieces 12*a* to 12*d* are released, the leg pieces 12*a* to 12*d* return to their original states by the springiness of the leg pieces 12*a* to 12*d*, so that the first locking pieces 13*a* are locked to a reverse face of the circuit board 2, and the second locking pieces 13*b* are locked to a top face of the circuit board 2. As a result, as shown in FIG. 19, the radiating conductor plate 8 is temporarily locked to the circuit board 2.

Then, the respective leg pieces 12*a* to 12*d* are soldered and connected to the first to fourth electrodes 5*a* to 5*d*, and the first and second feeding portions 9*a* and 9*b* are soldered to the wiring pattern 4 provided around the third holes 3*c*. The circuit board 2 and the radiating conductor plate 8 form an antenna body H.

In that case, the first to fourth leg pieces 12*a* to 12*d* and the first and second feeding portions 9*a* and 9*b* are not electrically connected with the ground conductor plate 1 by means of the escapes holes 1*g*.

The radiating conductor plate 8 attached to the circuit board 2 in that way is spaced from the ground conductor plate 1 and the circuit board 2 parallel thereto. The first electrical length of the radiating conductor plate 8 is determined depending on the length of the radiating conductor plate 8 on the line S1 and the capacitance of capacitors according to the electrodes 5*a* and 5*b*. Furthermore, the second electrical length of the radiating conductor plate 8 is determined depending on the length of the radiating conductor plate 8 on the line S2 and the capacitance of capacitors according to the electrodes 5*c* and 5*d*.

In the first embodiment, the length of the radiating conductor plate 8 on the line S1 and the length of the radiating conductor plate 8 on the line S2 are equal to each other.

However, since the capacity formed by the electrodes 5*a* and 5*b* is smaller than the capacity formed by the electrodes 5*c* and 5*d*, the first electrical length is smaller than the second electrical length, a difference is produced between both the first and second electrical lengths. Therefore, a circularly polarized wave antenna device can be obtained.

Further, when the radiating conductor plate 8 is attached to the circuit board 2, the ground conductor plate 1 having a larger area than the radiating conductor plate 8 exists below the entire radiating conductor plate 8, and the circuit board 2 is located in a planar region of the radiating conductor plate 8 between the radiating conductor plate 8 and the ground conductor plate 1.

Moreover, when the radiating conductor plate 8 is attached to the circuit board 2, the top faces of the hooking portions 1*a*, stopper portions 1*c* and the tall electronic components 6 are arranged to face the vicinities of the peripheral portion of the radiating conductor plate 8. The ends of the bent pieces 1*f* are arranged to face the radiating conductor plate 8. Thus, capacitance is generated between the hooking portions 1*a*, the stopper portions 1*c*, the tall electronic components 6 and the bent pieces 1*f*, and the radiating conductor plate 8.

Furthermore, when the radiating conductor plate 8 is attached to the circuit board 2, the hooking portions 1*a* and the stopper portions 1*c* are arranged along the outer circumferential edge of the radiating conductor plate 8. Thereby, the hooking portions 1*a* and the stopper portions 1*c* can be formed near the center C of the radiating conductor plate 8, so that the antenna device can be made small.

Further, the lengths of the radiating conductor plate 8 on the lines S1 and S2, and the capacitance generated by the first to fourth electrodes 5*a* to 5*d*, the capacitance between the hooking portions 1*a*, the stopper portions 1*c*, the tall electronic components 6 and the bent pieces if, and the radiating conductor plate 8 can lower a frequency. As a result, the antenna device can be made small.

Particularly, as shown in FIGS. 12 to 15, a cup-shaped cover 14 comprised of an insulative molded product has an octagonal top wall 14*a*, eight side walls 14*b* extending downward from eight sides of the top wall 14*a*, a receiving portion 14*c* surrounded by the top wall 14*a* and the side walls 14*b*, a concave portion 14*d* provided at a lower portion of one of the side walls 14*b*, hook-shaped locking portions 14*e* provided at the lower inner side of the alternate side walls 14*b*, and convex portions 14*f* protruding from the bottoms of the side walls 14*b* where the locking portions 14*e* are located.

When the cover 14 is pushed downward (toward the ground conductor plate 1) in a state in which the entire antenna body H comprised of the radiating conductor plate 8 and the circuit board 2 is received in the receiving portion 14 and in a state in which the locking portions 14*e* are matched with the hooking portions 1*a*, the locking portions 14*e* are locked below the hooking portions 1*a* by snapping, respectively, and hereby the cover 14 is attached to the ground conductor plate 1.

At this time, the convex portions 14*f* provided at the lower portions of the side walls 14*b* are fitted into the holes 1*b* adjacent to the hooking portions 1*a*, and the cable 7 is located inside the concave portion 14*d*, such that the cable 7 is pressed down.

A sealing sheet 15 is formed of a label, etc. on one side of which an adhesive material is applied, and the sealing sheet 15 is adhered to the reverse face of the ground conductor plate 1 so as to block the release portion 1*g*.

The antenna device according to the first embodiment of the present invention is formed by such construction.

Further, FIGS. 22 and 23 illustrate an antenna device according to a second embodiment of the present invention. Describing the construction of the antenna device according to the second embodiment, a radiating conductor plate 8 of this second embodiment has one feeding portion 9*b* having one bent piece provided on a line S2 passing through a center C thereof.

Also, an electric field of the radiating conductor plate 8 takes directions along lines S3 and S4 offset by 45 degrees with respect to the line S2 and passing through the center C, and has a first electrical length generated in the direction along the line S3, and a second electrical length generated in the direction along the line S4.

Further, adjusting means Z is provided at positions of the lines S3 and S4 that become the directions of an electric field, and is provided at spots excluding the central portion of the radiating conductor plate 8 between the central portion and the outer circumferential thereof. The electrical length can be adjusted so as to be longer by cutting cross-pieces 10*a* of the adjusting means Z which is formed in the shape of a ladder.

Further, the radiating conductor plate 8 has a pair of first opposing sides 11*a* and a pair of second opposing sides 11*b*, which are respectively located on lines S3 and S4 through the center C orthogonal to each other, and four leg pieces 12*a*, 12*b*, 12*c* and 12*c*, which are provided at spots excluding the central portion between the first opposites sides 11*a* on the line S3 and between the second opposing sides 11*b* on the line S4.

The four leg pieces 12*a* to 12*d* are formed to be bent downward at positions where the distances thereof from the center C are equal to each other, and are provided at positions closer to the center C than to the first and second opposing sides 11*a* and 11*b*.

Further, the electric field strength of the radiating conductor plate 8 is strong at certain spots at the outer circumferential portion of the radiating conductor plate on the lines S3 and S4. Accordingly, the leg pieces 12*a* to 12*d* are provided at spots that are located on the lines S3 and S4 to provide a relatively strong electric field strength.

Further, the first to fourth electrodes 5*a* to 5*d* to which the leg pieces 12*a* to 12*d* are respectively connected have different areas. Thus, a difference is produced between the first and second electrical lengths, so that a circularly polarized wave antenna device can be obtained.

The construction other than the above-described construction is similar to the construction in the first embodiment. Thus, the same portions are given the same reference numerals, and the detailed description thereof will be omitted herein.

Further, FIGS. 24 and 25 illustrates an antenna device according to a third embodiment of the present invention. In the antenna device of the third embodiment, the lengths of a radiating conductor plate 8 on lines S3 and S4 are equal to each other, and the areas of first to fourth electrodes 5*a* to 5*d* are equal to each other. Accordingly, since the electrical lengths are also equal to each other, an antenna device of a linearly polarized wave type can be obtained.

The construction other than the above-described construction is similar to the construction in the second embodiment. Thus the same portions are given the same reference numerals, and the detailed description thereof will be omitted herein.

Further, FIG. 26 illustrates an antenna device according to a fourth embodiment of the present invention. In the antenna device of this fourth embodiment, leg pieces 12*a* to 12*d* are respectively provided along first and second opposing sides 11*a* and 11*b* of a radiating conductor plate 8.

The construction other than the above-mentioned construction is similar to that in the first embodiment. Thus, the same portions are given the same reference numerals, and the detailed description thereof will be omitted herein.

Further, FIG. 27 illustrates an antenna device according to a fifth embodiment of the present invention. Describing the antenna device of this fifth embodiment, for example, as shown in FIG. 22, a radiating conductor plate 8 has first and second electrical lengths on lines S3 and S4 through a center C orthogonal to each other. Leg pieces 12*a* and 12*b* are provided on the line S3, and leg pieces 12*c* and 12*d* are provided on the line S4. Further, as shown in FIG. 27, the ends of the leg pieces 12*a*, 12*b*, 12*c* and 12*d* are provided with extending portions 12*e* for forming adjusting means Z.

Further, the first to fourth electrodes 5*a* to 5*d* provided on the circuit board 2 as described above are eliminated in this embodiment. The leg pieces 12*a* to 12*d* are respectively locked in penetrating portions 3*a* of the circuit board 2, or are attached to the circuit board 2 by press fitting or with an adhesive. The extending portions 12*e* are arranged to pass through the circuit board 2, the ground conductor plate 1, and a sealing sheet 15, and to protrude from the bottom. Also, the protruding ends of the extending portions 12*e* are cut so that the first and second electrical lengths can be adjusted.

In that case, the extending portions 12*e* for forming the adjusting means Z may be used together with the adjusting means Z formed in the shape of a ladder obtained by combining holes 10*a* with crosspieces 10*b*, which are provided in the radiating conductor plate 8. Otherwise, the extending portions 12*e* themselves may be separate adjusting means Z.

The construction other than the above-described construction is similar to the construction in the second embodiment. Thus, the same portions are given the same reference numerals, and the detailed description thereof will be omitted herein.

What is claimed is:

1. An antenna device comprising:

a ground conductor plate, and a radiating conductor plate made of a metal plate and spaced from the ground conductor plate, wherein the radiating conductor plate is provided with an adjustment element that adjusts an electrical length, the adjustment element formed in a shape of a ladder obtained by a combination of holes and crosspieces which are provided between a central portion and an outer circumferential edge of the radiating conductor plate, the crosspieces are cut to adjust the electrical length, the radiating conductor plate has at least one feeding portion, and the ladder-shaped portion is formed in a direction of an electric field generated on the radiating conductor plate.

2. The antenna device according to claim 1, wherein the radiating conductor plate has at least two feeding portions, and the adjusting means is provided on at least one line extending through a center of the radiating conductor plate from at least one of the two feeding portions.

3. The antenna device according to claim 1, wherein the radiating conductor plate has one feeding portion, and the adjusting means is provided along at least one of second and third lines passing through a center of the radiating conductor plate and offset by 45 degrees with respect to a first line through a center from the feeding portion.

4. The antenna device according to claim 1, further comprising a circuit board arranged between the ground conductor plate and the radiating conductor plate, wherein the radiating conductor plate has leg pieces attached to the circuit board and extending portions provided at ends of the leg pieces and protruding through the circuit board for forming the adjusting means, and the extending portions are cut to adjust the electrical length.

5. The antenna device according to claim 4, wherein the circuit board is placed on the ground conductor plate made of a metal plate, the radiating conductor plate has first and second electrical lengths on two lines passing through a center of the radiating conductor plate orthogonal to each other, two of the leg pieces are arranged correspondingly to the first and second electrical lengths, and the extending portions provided at the respective leg pieces protrude through the radiating conductor plate, and the extending portions protruding through the ground conductor plate are cut to adjust the electrical length.

* * * * *